US005277640A

United States Patent [19]

Shinmyou et al.

[11] Patent Number: 5,277,640

[45] Date of Patent: Jan. 11, 1994

[54] FRIT SEAL FURNACE AND MOUNT FOR CATHODE-RAY TUBE

[75] Inventors: Katsuhiko Shinmyou; Shigeru Yoshikawa; Kiyotaka Tanba, all of Inazawa, Japan

[73] Assignee: Sony Corporation, Tokyo, Japan

[21] Appl. No.: 857,930

[22] PCT Filed: Aug. 28, 1991

[86] PCT No.: PCT/JP91/01138

§ 371 Date: May 19, 1992

§ 102(e) Date: May 19, 1992

[87] PCT Pub. No.: WO92/05573

PCT Pub. Date: Apr. 2, 1992

[30] Foreign Application Priority Data

Sep. 20, 1990 [JP] Japan ..... 2-251349

[51] Int. Cl.[5] ..... H01J 9/26

[52] U.S. Cl. ..... 445/66; 269/15; 269/908

[58] Field of Search ..... 445/45, 66; 65/155; 198/465.3, 803.2; 269/908, 15; 432/239, 261

[56] References Cited

U.S. PATENT DOCUMENTS

| | | | |
|---|---|---|---|
| 834,037 | 10/1906 | Arthur | 198/803.2 |
| 1,770,039 | 1/1927 | Mayeur | 432/239 |
| 3,329,422 | 7/1967 | Hajduk | 269/908 |
| 3,559,836 | 9/1969 | Pink | 432/261 X |

FOREIGN PATENT DOCUMENTS

| | | |
|---|---|---|
| 58-53133 | 3/1983 | Japan . |
| 59-138035 | 8/1984 | Japan . |

*Primary Examiner*—Kenneth J. Ramsey

*Attorney, Agent, or Firm*—Hill, Steadman & Simpson

[57] ABSTRACT

A mount for supporting a cathode-ray tube is employed in a frit sealing furnace. The frit seal furnace (1) comprises a furnace body (3) and conveyor belts (5) disposed in the furnace body (3) for feeding mounts (21) which each support a panel (31) and a funnel (32) that are superposed one on the other with a frit glass (33) interposed therebetween. Each of the conveyor belts (5) is composed of a pair of chain belts (4*a*, 4*b*). The mount (21) is placed on the conveyor belts (5) in the frit seal furnace (1) through a space which comprises a mesh screen (26), so that the mount (21) is suitable for use in the frit seal furnace (1). When the tube body of a cathode-ray tube is broken, glass pieces are prevented from falling onto the furnace floor by the mesh screen. The mesh screen does not obstruct air flows in the furnace.

1 Claim, 4 Drawing Sheets

FRIT SEAL FURNACE AND MOUNT FOR CATHODE-RAY TUBE

TECHNICAL FIELD

The present invention relates to a frit seal furnace for joining the panel and funnel of a cathode-ray tube to each other with a frit seal, and a mount for supporting a cathode-ray tube in such a frit sealing furnace.

BACKGROUND ART

Process of manufacturing cathode-ray tubes such as color cathode-ray tubes or monochromatic cathode-ray tubes include a step of joining a panel and a funnel to each other while they are passing through a frit sealing furnace, i.e., joining them to each other with a frit seal. Usually, a frit seal furnace comprises a furnace body having a heating means and a conveyor belt extending through the furnace body. On the conveyor belt, there is placed a mount which supports a tube body composed of a panel and a funnel that are superposed one on the other with a frit glass interposed therebetween. The panel and the funnel are joined to each other with a frit seal when they are fed through the furnace body by the conveyor belt.

Heretofore, the conveyor belt in a frit seal furnace is in the form of a mesh belt combined with a helical coil. In the frit seal furnace, a jet nozzle is attached to the neck to bake an intermediate film (primal film) coated in the step of forming a fluorescent surface, and air if caused to flow upwardly for joining the panel and the funnel with a frit seal while replacing air in the tube body.

The mount for supporting the panel and the funnel comprises a base in the form of a frame, a holder connected to the base by a plurality of legs for engaging a round portion (circular portion at the boundary between the neck and the funnel) of the tube body, and abutments for abutting respectively against three sides of the panel and the funnel In the conventional frit seal furnace, the mesh belt (conveyor belt) of metal is driven in sliding engagement with metal skid rails which support the mesh belt. Therefore, metal particles are scraped off by sliding frictional engagement between the mesh belt and the metal skid rails. These metal particles fly up because of the upward air streams, and tend to be attached to the frit glass. As a result, the completed cathode-ray tube has a deteriorated pressure resistance at the frit seal region.

During long usage of the frit seal furnace, metal particles produced as described above and glass pieces of broken tube bodies are deposited on the floor of the frit seal furnace. When the deposited metal particles and glass pieces are to be removed, the metal belt is cut off to provide a gap, and the furnace floor is cleaned with a cleaner through the gap while moving the metal belt. Consequently, it is time-consuming to clean the furnace floor.

After the furnace floor has been cleaned up, the metal belt is joined again. However, the restored metal belt contacts a drive drum under a different condition, and is liable to become tortuous. As it takes considerable time to make adjustments for reducing such a tortuous condition of the metal belt, the initial process of starting to operate the frit seal furnace is delayed.

In view of the aforesaid drawbacks of the prior art, it is an object of the present invention to provide a frit seal furnace which is capable of suppressing the production of metal particles that would adversely affect the pressure resistance of the frit seal region of a cathode-ray tube, and also of improving the process of cleaning a furnace floor and reducing a tortuous condition of a conveyor belt.

Another object of the present invention is to provide a mount for supporting a cathode-ray tube in such a frit seal furnace.

DISCLOSURE OF THE INVENTION

According to the present invention, a frit seal furnace 1 comprises a furnace body 3 having a heating means and conveyor belts 5 disposed in the furnace body 3 for feeding mounts 21 which each support a panel 31 and a funnel 32 that are superposed one on the other with a frit glass 33 interposed therebetween, each of the conveyor belts 5 being composed of a pair of chain belts 4*a*, 4*b*.

As described above, each conveyor belt 5 is composed of a pair of chain belts 4*a*, 4*b*. When the chain belts 4*a*, 4*b* are driven, rolling frictional engagement takes place between chain rollers 9 and chain rails 12, and the production of any metal particles is suppressed. As a result, since metal particles do not fly up and are not attached to a frit glass, the panel and the funnel can be joined to each other with a frit seal that is highly pressure-resistant. Sufficient space is available between the chain belts 4*a*, 4*b* for allowing a cleaner to easily clean a furnace bottom without the need for cutting off the conveyor belt 5. The chain belts 4*a*, 4*b* are driven by mesh with sprockets 17. Therefore, the chain belts 4*a*, 4*b* are prevented from becoming tortuous, and the frit seal furnace 1 can initially start to operate much faster than heretofore after the furnace floor has been cleaned.

According to the present invention, furthermore, each of the mounts 21 for supporting a cathode-ray tube is placed on a pair of conveyor chain belts 4*a*, 4*b* in the frit seal furnace, and has a surface in the form of a mesh screen 26 which is placed on the chain belts 4*a*, 4*b*.

Inasmuch as the region of the chain belts 4*a*, 4*b* on which each of the mounts 21 is placed is covered with a mesh screen 26, even when a tube body 34 supported on the mount in the furnace 1 is broken, glass pieces of the broken tube body 34 are prevented from falling onto the furnace floor by the mesh screen 26. The glass pieces on the mesh screen 26 will be processed outside of the furnace. Since the bottom of each mount 21 comprises a mesh screen 26, it does not obstruct the flow of air in the furnace. Consequently, the mesh screen is suitable for use in each mount in the furnace 1.

BEST MODE FOR CARRYING OUT THE INVENTION

A frit seal furnace and a mount for supporting a cathode-ray tube in such a frit sealing furnace according to the present invention will hereinafter be described with reference to the drawings.

Figure 1:
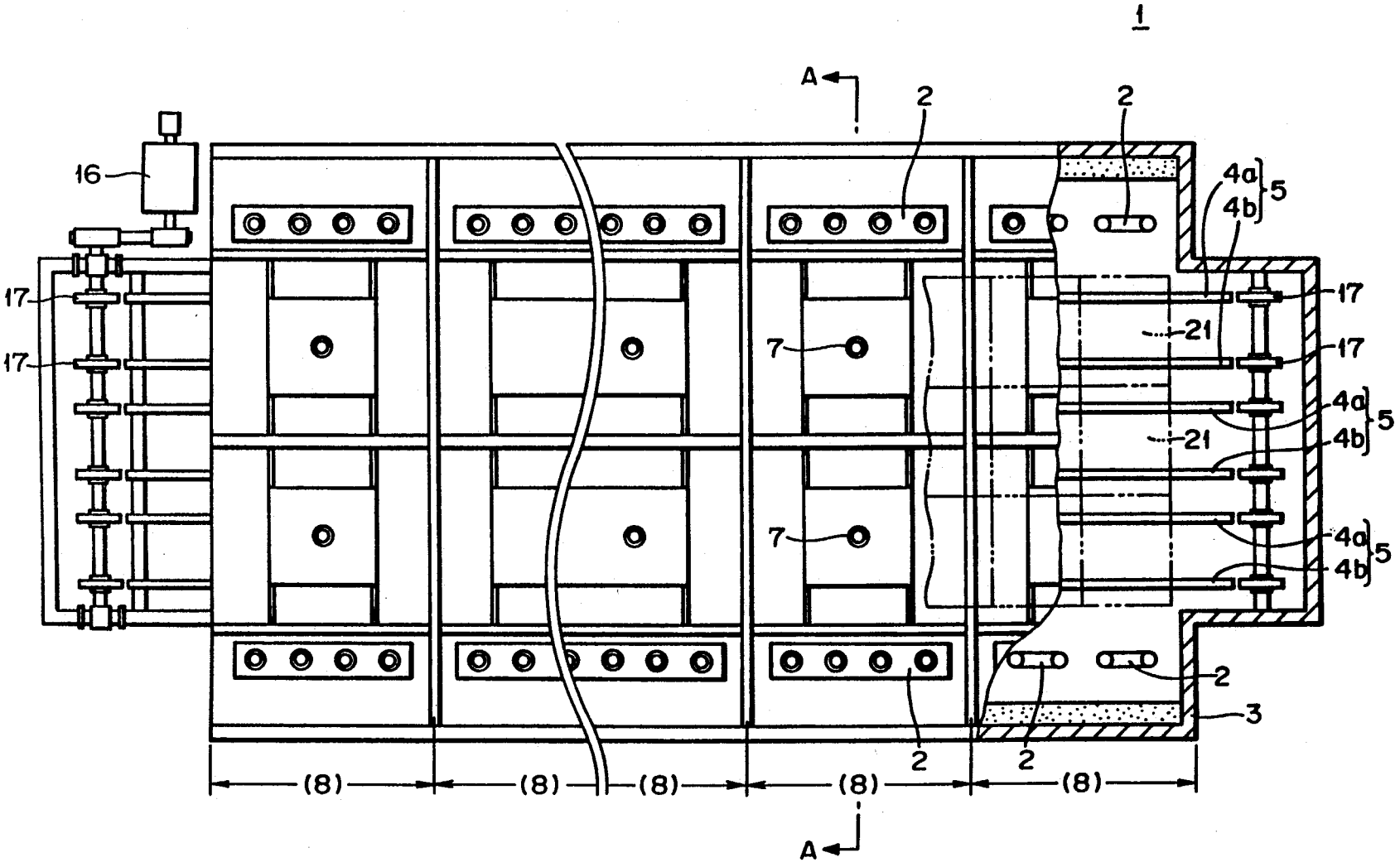
FIG. 1 is a plan view of a frit seal furnace according to the present invention.
Figure 2:
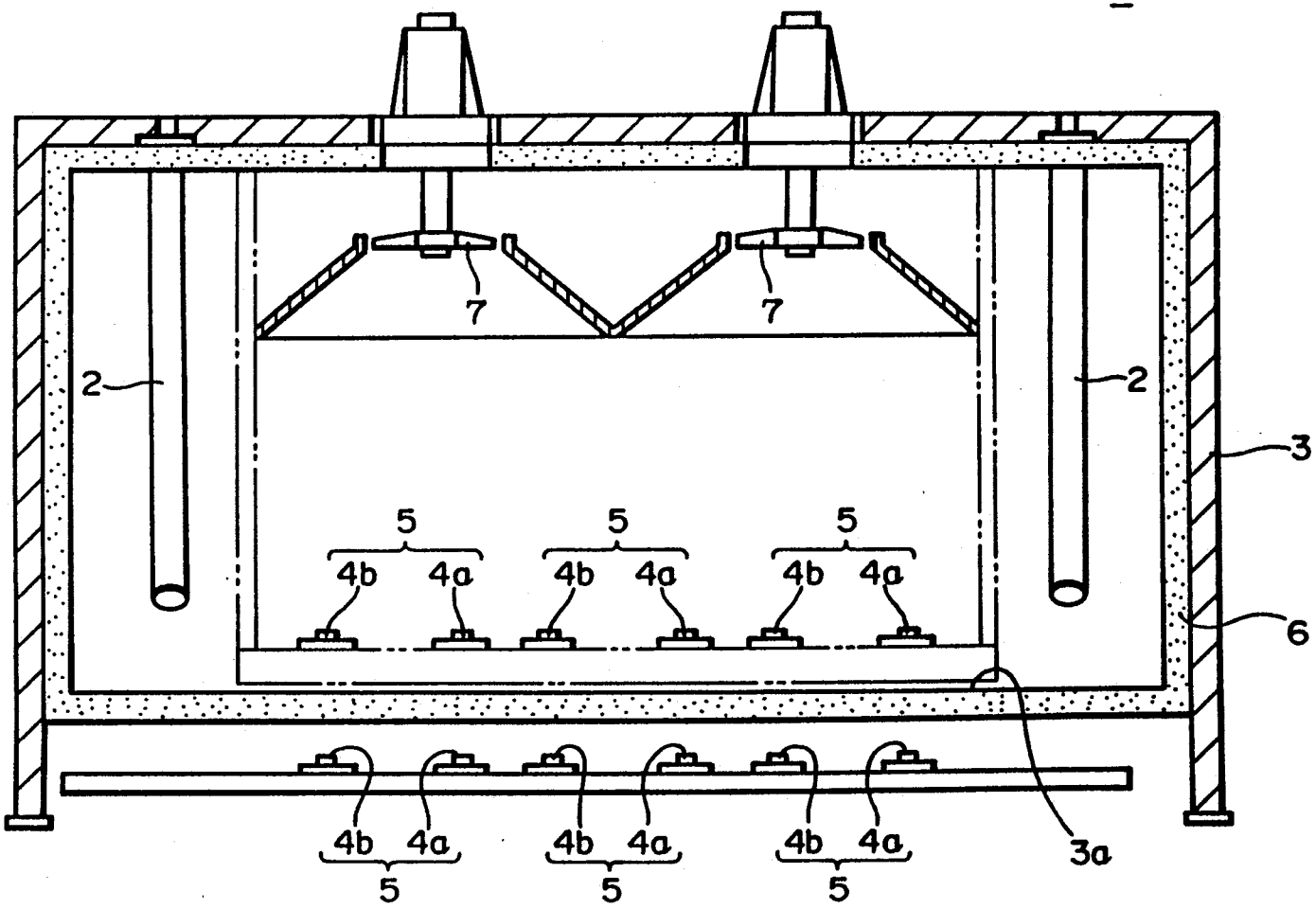
FIG. 2 is a cross-sectional view taken along line A—A of FIG. 1.

FIG. 1 is a plan view of a frit seal furnace according to the present invention, and FIG. 2 is a cross-sectional view taken along line A—A of FIG. 1. A frit seal furnace 1 comprises a furnace body 3 having heating means (such as tube burners) 2 and conveyor belts 5 movable in the furnace body 3. The furnace body 3 is lined with a heat insulation 6, and the heating means 2 are disposed in aligned positions on opposite sides of the conveyor belts 5. Fans 7 are disposed above the conveyor belts 5 for directing air downwardly in the furnace. The heating means 2 are divided into zones 8 arranged along the direction in which the conveyor belts 5 move. There are a plurality of, two in the illustrated embodiment, fans 7 in each of the zones 8.

Figure 4:
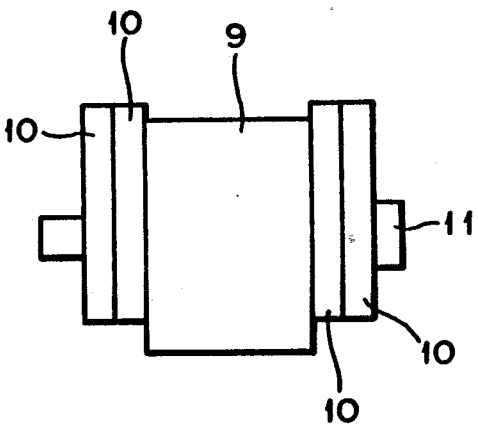
FIG. 4 is a side elevational view of the chain belt.
Figure 3:
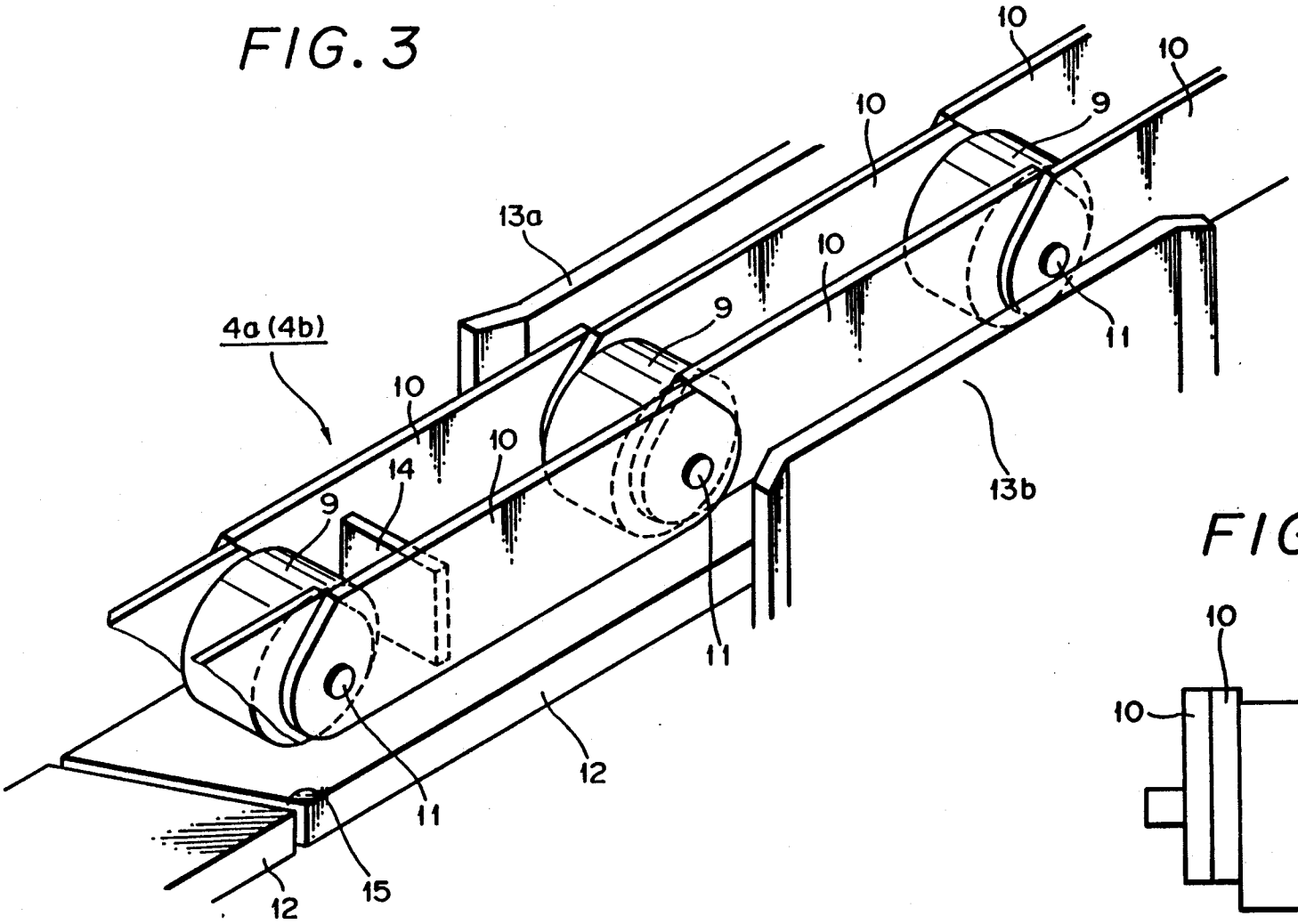
FIG. 3 is a perspective view of a chain belt.

Each of the conveyor belts 5 comprises a pair of chain belts 4 [4*a*, 4*b*]. As shown in FIGS. 3 and 4, each of the chain belts 4*a*, 4*b* comprises a multiplicity of links 10 extending in the longitudinal direction in sandwiching relationship to spaced chain rollers 9, and angularly movably supported on roller shafts 11 with the ends of adjacent links 10 overlapping each other. The chain belts 4*a*, 4*b* are arranged such that their rollers 9 are held in rolling contact with chain rails 12. Chain guides 13*a*, 13*b* are disposed on opposite sides of each of the chain rails 12, the chain guides 13*a*, 13*b* being spaced at certain intervals in the longitudinal direction of the chain rails 12. The chain belts 4*a*, 4*b* have cleaning plates (or scrapers) 14 each in combination with a plurality of links 10 (32 links in the illustrated embodiment) for removing glass pieces that have dropped on the rails 12. Each of the rails 12 has slots 12 at certain intervals for discharging glass pieces that have been cleared by the plates 14. Each of the conveyor belts 5, which is composed of a pair of chain belts 4*a*, 4*b*, flexibly extends, and can be driven in a circulating fashion, over and below a furnace floor 3*a*. The conveyor belts 5 are operatively coupled to sprockets 17 that are driven by a drive source 16 at an end of the furnace. In the illustrated embodiment, three laterally juxtaposed mounts 21 are fed in the furnace 1, and hence three conveyor belts 5, each composed of a pair of chain belts 4*a*, 4*b*, (i.e., a total of six chain belts 4), are disposed in the furnace 1.

Figure 5:
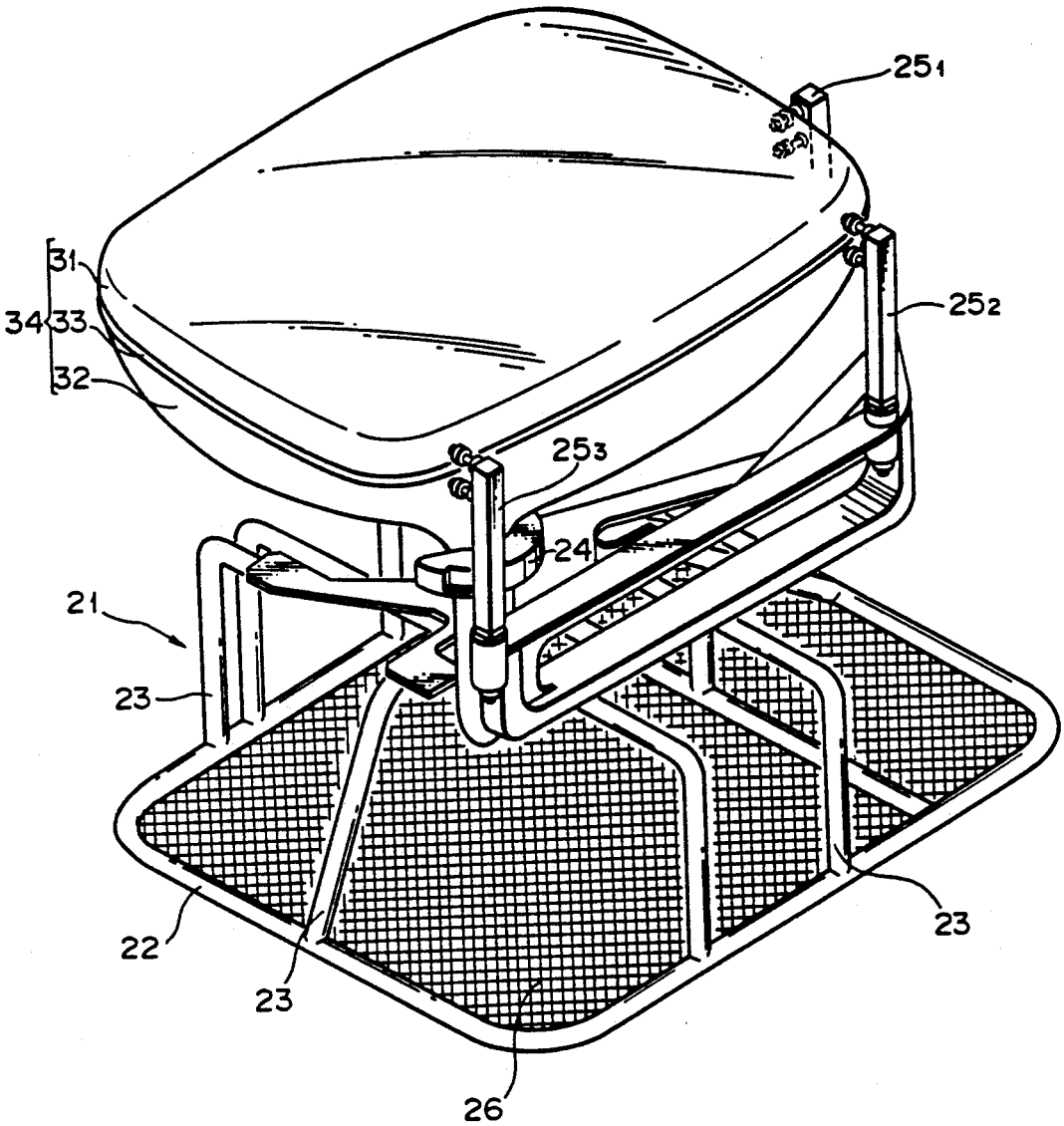
FIG. 5 is a perspective view of a mount for a cathode-ray tube according to the present invention.

As shown in FIG. 5, a tube body 34 is composed of a panel 31 and a funnel 32 that are superposed one on the other with a frit glass 33 interposed therebetween. Each of the mounts 21, for supporting the tube body 34, comprises a base 22 in the form of a frame, a holder 24 connected to the base 22 by a plurality of legs 23 for engaging a round portion of the tube body 34, and abutments 25 [$25_1$, $25_2$, $25_3$] for abutting respectively against three sides of the panel 31 and the funnel 32. The mount 21 also has a mesh screen (of expanded metal) 26 as a floor surface, i.e., a surface where the mount 21 is placed on the conveyor belt 5 in the frit seal furnace 11.

In the frit seal furnace 1 of the above structure, each of the conveyor belts 5 comprises a pair of chain belts 4*a*, 4*b*, and is driven by the sprocket 17 with the chain rollers 9 held in rolling contact with the chain rail 12. Therefore, when the conveyor belts 5 are driven, only rolling frictional engagement takes place between the chain rollers 9 and the chain rails 12, minimizing the production of any metal particles. In addition, since air is caused to flow downwardly in the furnace 1 by the fans 7, any metal particles are prevented from being attached to the frit glass 33, allowing the panel 31 and the funnel 32 to be joined to each other with a frit seal that is highly pressure-resistant.

When the furnace floor 3*a* is to be cleaned after long usage thereof, since there is a sufficient space between the chain belts 4*a*, 4*b*, the furnace floor 3*a* can easily be cleaned with a cleaner inserted between the chain belts 4*a*, 4*b*. Glass pieces that may have dropped on the chain rails 12 are cleared by the cleaning plates 14 moving with the chain belts 4*a*, 4*b*, and discharged through the slots 15. Inasmuch as the chain belts 4*a*, 4*b* are employed and driven by the sprockets 17, they are prevented from becoming tortuous unlike the conventional mesh belts. When the furnace floor is to be cleaned, the conveyor belts are not required to be cut off. This, together with the fact that the chain belts 4*a*, 4*b* do not become tortuous, permits the frit seal furnace 1 to initially start operating quickly after the furnace floor has been cleaned.

The fluorescent surface of each cathode-ray tube can be pre-baked before the panel and the funnel are joined to each other with a frit seal. As it is possible to insert an air nozzle into the tube body 34 from below in the frit seal furnace 1, clean air may be supplied from an external source through the air nozzle into the tube body 34 to replace the air in the tube body 34, while at the same time baking an intermediate film (primal film) of the fluorescent surface.

There are three laterally juxtaposed mounts 21, which each support a tube body 34 that is composed of a panel 31 and a funnel 32 that are superposed one on the other with a frit glass 33 interposed therebetween, placed on the conveyor belts 5 in the frit seal furnace 1 and closely held together. The mounts 21 are also held in intimate contact in the direction in which they are fed by the conveyor belts 5. Since the mesh screens 26 are disposed at the bottoms of the respective mounts 21, glass pieces that may fall when the tube body 34 is broken in the furnace 1 are retained on the mesh screens 26 and prevented from falling onto the furnace floor 3*a*. Those glass pieces that have fallen on the mesh screens 26 can be removed when the mounts 21 are moved out of the furnace 21. Smaller glass pieces that fall on the furnace floor may be removed periodically by the cleaning process described above.

In the conventional frit seal furnace in which air flows upwardly, frit glass particles are attached to the front surface of the panel 31 by the upward air flow, and become crystallized. A certain dedicated means is required for the removal of such crystallized frit glass. In the frit seal furnace 1 according to the present invention, however, since air is caused flow downwardly by the fans 7, the frit glass is prevented from being attached to the front surface of the panel 31.

What is claimed is:

1. A mount comprising means for supporting a cathode-ray tube, to be placed on a pair of conveyor chain belts in a frit seal furnace, said means for supporting including a debris retaining means comprising a mesh screen.

* * * * *